US005160092A

United States Patent [19]

Rose et al.

[11] Patent Number: 5,160,092

[45] Date of Patent: Nov. 3, 1992

[54] SPRAY GUN TRIGGER GUARD APPARATUS

[76] Inventors: James P. Rose, P.O. Box 188; Norville W. Phillips, 15435 Ave. C., both of Channelview, Tex. 77530

[21] Appl. No.: 818,251

[22] Filed: Jan. 8, 1992

[51] Int. Cl.[5] ..... B05B 15/00

[52] U.S. Cl. ..... 239/288.5; 239/288; 239/530

[58] Field of Search ..... 239/288, 288.3, 288.5, 239/525, 530

[56] References Cited

U.S. PATENT DOCUMENTS 3,944,141 3/1976 Siczek ..... 239/288.5

*Primary Examiner*—Andres Kashnikow
*Assistant Examiner*—Lesley D. Morris
*Attorney, Agent, or Firm*—Leon Gilden

[57] ABSTRACT

A spray gun formed with an elongate housing, with an outlet nozzle directed from the housing cooperative from a housing handle reservoir and operative through a trigger plate pivotally mounted relative to the housing. The trigger plate includes spaced end walls, with "U" shaped guard members mounted to the end walls. A "U" shaped guard member includes first and second leg plates that are parallel relative to one another and extend through respective first and second enclosed slots between the "U" shaped guards and the first and second end walls. The leg plates include spaced abutments for cooperation with the guards, with the "U" shaped guard member including an interposed spring between the guard member and the handle reservoir to bias the abutments in cooperation with the "U" shaped guards. Manual depression of the guard member against the spring displaces the abutments relative to the "U" shaped permitting operation and pivotment of the trigger plate to effect operation of the spray gun.

4 Claims, 4 Drawing Sheets

SPRAY GUN TRIGGER GUARD APPARATUS

BACKGROUND OF THE INVENTION

1. Field of the Invention

The field of invention relates to spray gun apparatus, and more particularly pertains to a new and improved spray gun trigger guard apparatus wherein the same is arranged to prevent inadvertent discharge of a spray gun member.

2. Description of the Prior Art

Accidental discharge of a spray gun is an ever-present hazard in utilization of a spray gun structure. Various guard members are provided in the prior art relative to such a spray gun apparatus, but none have heretofore utilized a positive abutment structure as set forth by the instant invention to prevent inadvertent discharge of the spray gun assembly. A spray gun nozzle formed with a safety guard to prevent spray from certain portions relative to the outlet of the nozzle is set forth in the U.S. Pat. No. 4,165,836 to Eull.

U.S. Pat. No. 3,507,451 to Johnson sets forth an example of a spray gun assembly.

U.S. Pat. No. 3,674,074 to Labis sets forth a cover member for a spray gun.

As such, it may be appreciated that there continues to be a need for a new and improved spray gun trigger guard apparatus as set forth by the instant invention which addresses both the problems of ease of use as well as effectiveness in construction for preventing inadvertent actuation of a spray gun by pivotment of the trigger and in this respect, the present invention substantially fulfills this need.

SUMMARY OF THE INVENTION

In view of the foregoing disadvantages inherent in the known types of spray gun apparatus now present in the prior art, the present invention provides a spray gun trigger guard apparatus wherein the same is arranged to prevent pivotal displacement of the trigger relative to a spray gun structure. As such, the general purpose of the present invention, which will be described subsequently in greater detail, is to provide a new and improved spray gun trigger guard apparatus which has all the advantages of the prior art spray gun apparatus and none of the disadvantages.

To attain this, the present invention provides a spray gun formed with an elongate housing, with an outlet nozzle directed from the housing cooperative from a housing handle reservoir and operative through a trigger plate pivotally mounted relative to the housing. The trigger plate includes spaced end walls, with "U" shaped guard members mounted to the end walls. A "U" shaped guard member includes first and second leg plates that are parallel relative to one another and extend through respective first and second enclosed slots between the "U" shaped guards and the first and second end walls. The leg plates include spaced abutments for cooperation with the guards, with the "U" shaped guard member including an interposed spring between the guard member and the handle reservoir to bias the abutments in cooperation with the "U" shaped guards. Manual depression of the guard member against the spring displaces the abutments relative to the "U" shaped guards permitting operation and pivotment of the trigger plate to effect operation of the spray gun.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spray gun trigger guard apparatus which has all the advantages of the prior art spray gun apparatus and none of the disadvantages.

It is another object of the present invention to provide a new and improved spray gun trigger guard apparatus which may be easily and efficiently manufactured and marketed.

It is a further object of the present invention to provide a new and improved spray gun trigger guard apparatus which is of a durable and reliable construction.

An even further object of the present invention is to provide a new and improved spray gun trigger guard apparatus which is susceptible of a low cost of manufacture with regard to both materials and labor, and which accordingly is then susceptible of low prices of sale to the consuming public, thereby making such spray gun trigger guard apparatus economically available to the buying public.

Still yet another object of the present invention is to provide a new and improved spray gun trigger guard apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
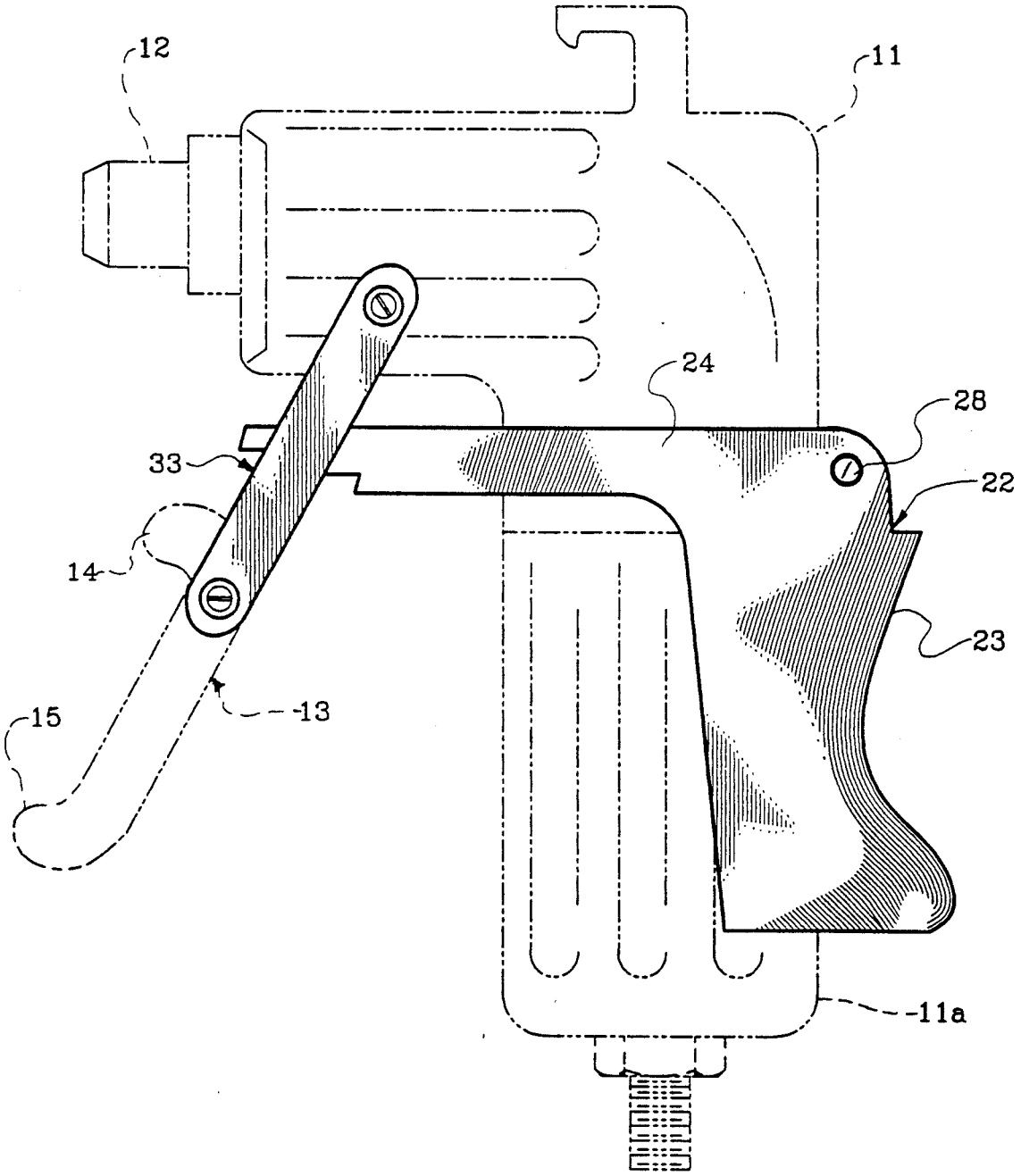
FIG. 1 is an orthographic side view of the instant invention in an engaged orientation.
Figure 2:
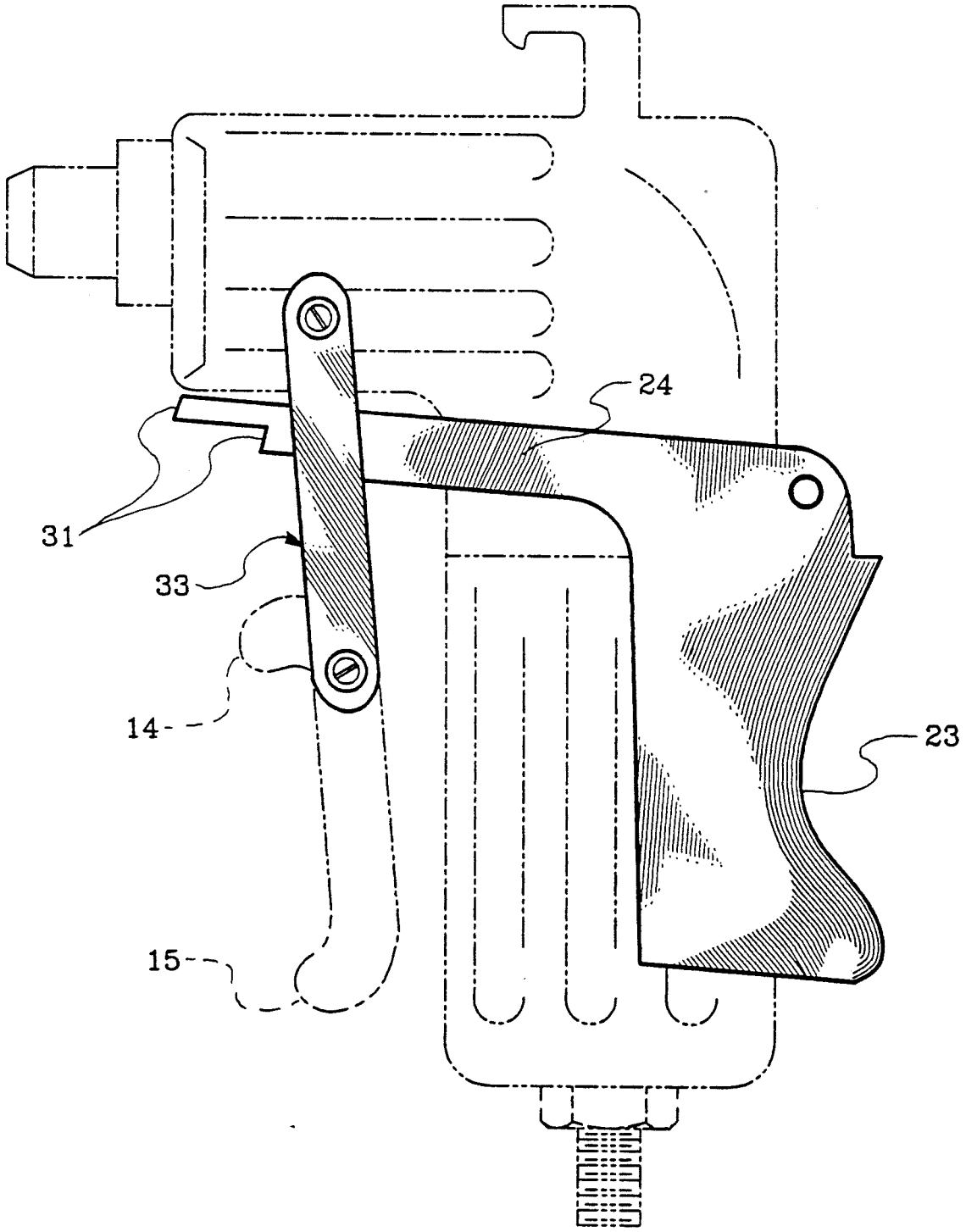
FIG. 2 is an orthographic side of the invention in disengaged orientation permitting projection of the leg plates of the guard member housing to be displaced relative to "U" shaped guards mounted to the trigger structure of the spray gun.
Figure 3:
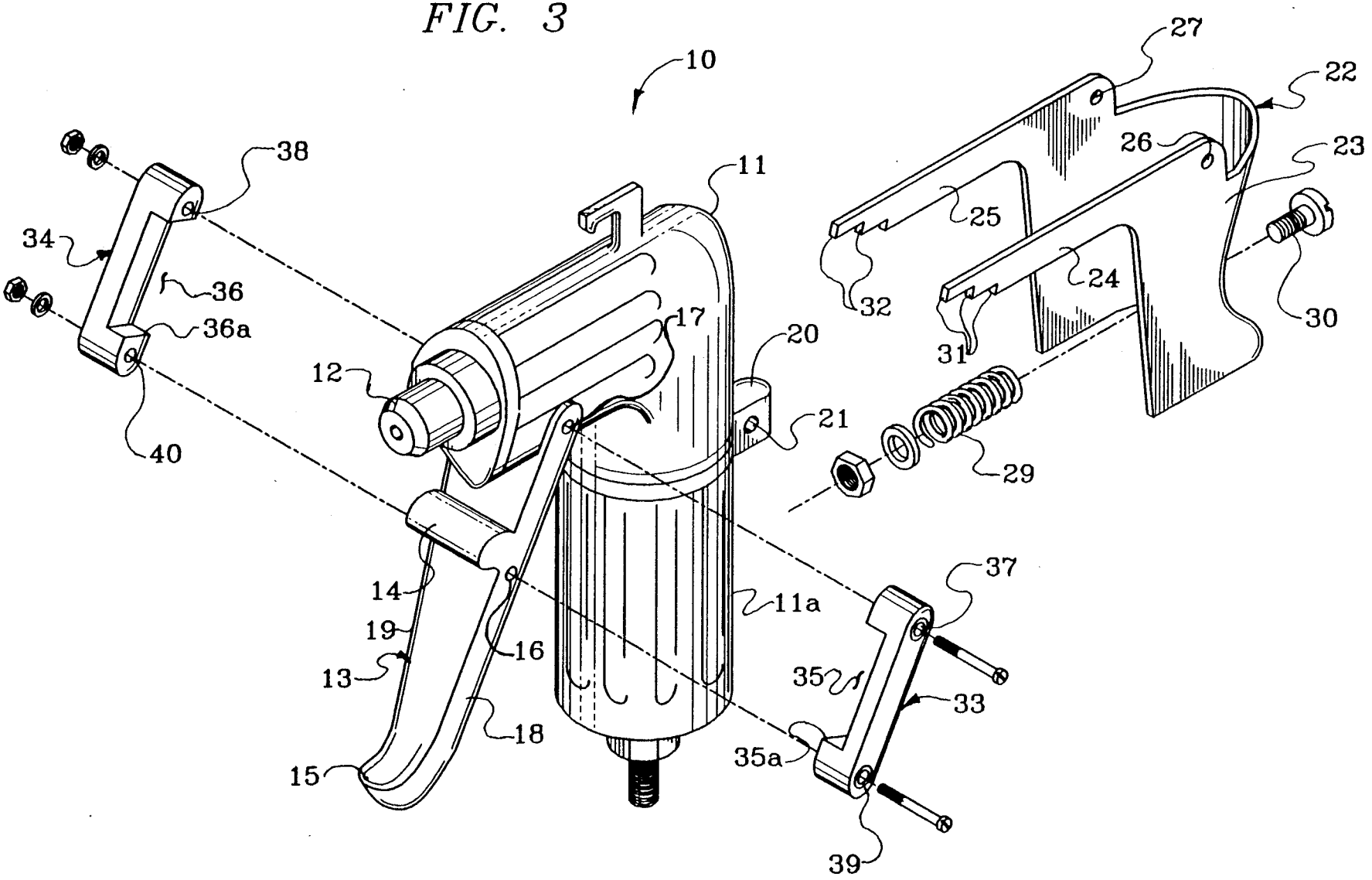
FIG. 3 is an isometric illustration of the invention in an exploded illustration.

With reference now to the drawings, and in particular to FIG. 1 to 5 thereof, a new and improved spray gun trigger guard apparatus embodying the principles and concepts of the present invention and generally designated by the reference numeral 10 will be described.

More specifically, the spray gun trigger guard apparatus 10 of the instant invention essentially comprises in combination with a spray gun housing 11 that includes a housing handle extension reservoir 11*a*. A spray gun outlet conduit 12 is substantially orthogonally oriented relative to the handle reservoir 11*a*, with a trigger plate 13 pivotally mounted at its bifurcated upper distal end to the housing 11. The trigger plate 13 includes a plate first flange 14 projecting from a forward face of the trigger plate extending orthogonally between trigger plate first and second end walls 18 and 19. A trigger plate second flange 15 positioned at a lower distal end of the trigger plate is oriented parallel relative to the first flange. A trigger plate first bore 16 is orthogonally directed through the first and second end walls 18 adjacent the first flange 14, with the trigger plate second bore 17 pivotally mounting the upper distal end of the trigger plate to the housing, in a manner as illustrated in the FIG. 3. A trigger housing boss 20 is fixedly mounted to the trigger housing adjacent the handle reservoir 11*a* diametrically opposed to the positioning of the trigger plate 13 relative to the housing, wherein the trigger housing boss 20 includes a trigger housing boss bore 21 directed through the trigger housing boss 20, wherein the bore 21 is oriented parallel relative to the first and second bores 16 and 17.

A "U" shaped guard member housing 22 includes an arcuate rear web 23, with a first and second leg plate 24 and 25 projecting forward of the arcuate rear web 23, with the first and second leg plates 24 and 25 oriented in a parallel and coextensive relationship relative to one another. A first leg plate bore 26 and a second leg plate bore 27 are directed through the "U" shaped guard member housing 22 at rear distal end portions of the first and second leg plate members 24 and 25 respectively. A first lock pin 28 directed through the first and second leg plate bores 26 and 27 is also directed through the coaxed aligned housing boss bore 21 to pivotally secure the "U" shaped guard member housing 22 to the spray gun housing 11. A spring member 29 interposed between the handle reservoir 11*a* and an interior surface of the arcuate rear web 23 biases the arcuate rear web 23 outwardly relative to the handle reservoir 11*a*. A guide rod 30 directed through the arcuate rear web 23 positions and orients the spring member 29 in a manner as illustrated in the FIG. 5 for example. Second leg plates 24 and 25 have formed at their forward distal ends respective first and second abutment surfaces 31 and 32 respectively that are arranged orthogonally oriented relative to the longitudinally aligned first and second respective leg plates 24 and 25. Abutment surfaces 31 and 32 are arranged for engagement with the respective first and second lower lugs 35*a* and 36*a* formed at lower portions of respective first and second enclosed slots 35 and 36. The first and second respective slots 35 and 36 are defined between respective first and second "U" shaped guides 33 and 34 and the respective first and second end walls 18 and 19. The first and second "U" shaped guides 33 and 34 include respective first and second guides first bores 37 and 38 coaxially aligned with the second bore 17 and respective first and second guide second bores 39 and 40 coaxially aligned with the first bores 16. In this manner, the normally outwardly biased "U" shaped guard member housing 22 effects engagement of the respective abutment surfaces 31 and 32 with respective first and second lower lugs 35*a* and 36*a* of the respective first and second "U" shaped guides 33 and 34. To effect manual depression and biasing of the "U" shaped housing 22 against the spring 29 effects a lifting of the abutment surfaces 31 and 32 relative to the lower lugs 35*a* and 36*a* to permit typical and normal usage of the gun and depressing of the trigger plate in its function.

Figure 4:
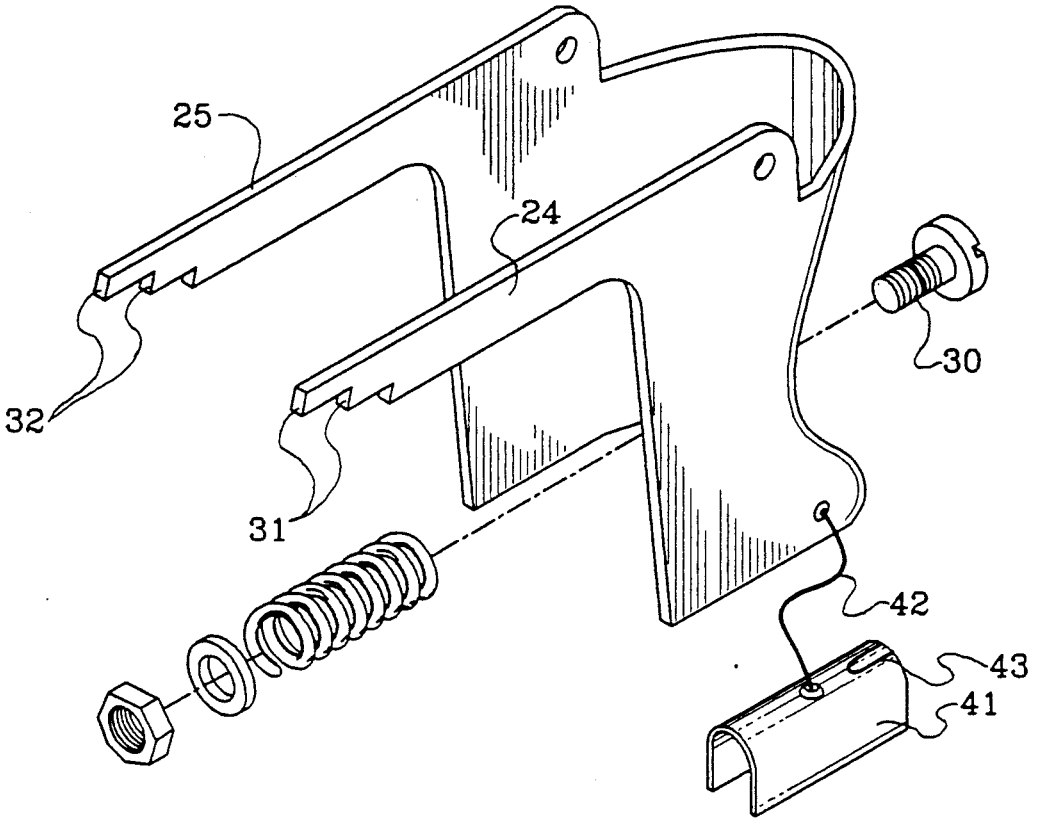
FIG. 4 is an isometric illustration of the "U" shaped guard member housing utilizing an additional abutment shield.
Figure 5:
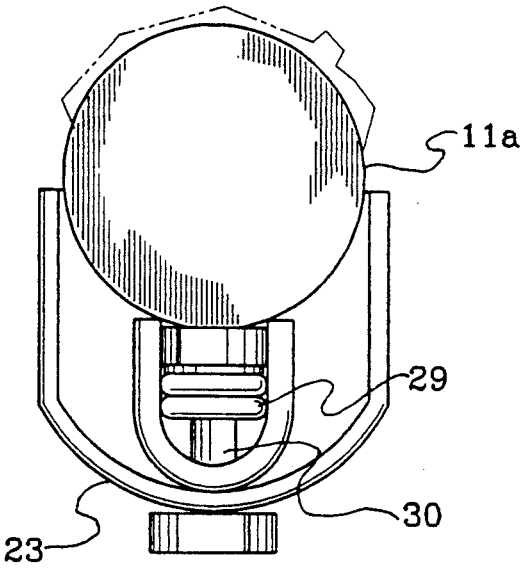
FIG. 5 is an orthographic top view of the abutment shield in use.

The FIGS. 4 and 5 further note the use of a "U" shaped abutment shield 41 that is formed with a tether line 42 securing the shield to the "U" shaped guard member housing 22, wherein a shield slot 43 directed through a lower edge of the shield 41 is arranged for reception of the guide rod 30 to effect a positive abutment between the shield and the handle reservoir 11*a* to prevent a further positive engagement of the "U" shaped abutment shield 41 and the handle reservoir 11*a* preventing displacement of the abutment surfaces 31 and 32 relative to the lower first and second lugs 35*a* and 36*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spray gun trigger guard apparatus, comprising, a spray gun including a spray gun housing, the spray gun housing including a housing handle reservoir extending downwardly and coaxially aligned relative to the housing, with housing including an outlet conduit orthogonally oriented relative to the handle reservoir, and a trigger plate, the trigger plate including a bifurcated upper distal end, and the upper distal end pivotally mounted to the housing, and the housing further including a second bore directed through the housing pivotally mounting the bifurcated upper distal end of the trigger plate, and the trigger plate including a first bore directed through the trigger plate, wherein the first bore is oriented parallel relative to the second bore, and the trigger plate includes a first end wall spaced from a second end wall, and the first bore is directed through the first end wall and the second end wall, and a trigger housing boss fixedly mounted to the housing adjacent the handle reservoir, with the housing boss diametrically opposed to the trigger plate and the trigger housing boss including a boss bore directed therethrough, the boss bore oriented parallel to the first bore into the second bore, and "U" shaped guard means pivotally mounted to the housing for effecting selective abutment of the trigger plate relative to the housing.

2. An apparatus as set forth in claim 1 wherein the guard means includes a "U" shaped guard member housing, the "U" shaped guard member housing including an arcuate rear web extending downwardly along the housing reservoir from the housing, the arcuate rear web including a first leg plate and a second leg plate, the first leg plate and the second leg plate arranged in a parallel coextensive relationship relative to one another extending from the arcuate rear web forwardly beyond the trigger plate, and a first "U" shaped guard mounted to the first end wall, and a second "U" shaped guard mounted to the second end wall, the first "U" shaped guard and the second "U" shaped guard including respective guide first bores, the first and second guide first bores are coaxially aligned with the second bore to receive a lock pin therethrough, and the first and second "U" shaped guides including respective first and second lower lugs spaced from the respective first and second guide first bores, wherein the first and second lower lugs include respective first and second guide second bores directed therethrough, wherein the first and second guide second bores are coaxially aligned relative to one another and to the first bore positioned between the first and second guide second bores to receive a further lock pin therethrough, wherein a first enclosed slot is defined between the first "U" shaped guide and the first end wall and a second enclosed slot is defined between the second "U" shaped guide and the second end wall, wherein the first leg plate extends to the first enclosed slot and the second leg plate extends through the second enclosed slot, with the first leg plate including first abutment surfaces that are oriented orthogonally relative to the first leg plate and the second leg plate including second abutment surfaces oriented orthogonally relative to the second leg plate, wherein the first and second respective abutment surfaces are arranged for engagement with respective first and second lower lugs when the arcuate rear web is pivotally spaced relative to the handle reservoir.

3. An apparatus as set forth in claim 2 including a guide rod orthogonally directed through the arcuate rear web, and wherein the guide rod includes a guide spring, the guide spring arranged for abutment and captured between the arcuate rear web and the handle reservoir to bias the arcuate rear web from the handle reservoir about the tubular housing boss bore.

4. An apparatus as set forth in claim 3 further including an abutment shield, the abutment shield of a generally "U" shaped configuration, with the abutment shield including a tether line securing the abutment shield to the "U" shaped guard member housing, the abutment shield including a slot directed from a lower edge of the abutment shield to receive the guide rod therewithin, with the abutment shield arranged for positioning between the arcuate rear web and the handle reservoir to maintain the arcuate rear web in a spaced relationship relative to the handle reservoir.

* * * * *